US010386062B2

(12) United States Patent
Karkow et al.

(10) Patent No.: US 10,386,062 B2
(45) Date of Patent: Aug. 20, 2019

(54) METHOD FOR OPERATING A COMBUSTION SYSTEM INCLUDING A PERFORATED FLAME HOLDER

(71) Applicant: CLEARSIGN COMBUSTION CORPORATION, Seattle, WA (US)

(72) Inventors: Douglas W. Karkow, Des Moines, WA (US); Joseph Colannino, Bellevue, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 90 days.

(21) Appl. No.: 15/235,634

(22) Filed: Aug. 12, 2016

(65) Prior Publication Data

US 2016/0348899 A1 Dec. 1, 2016

Related U.S. Application Data

(63) Continuation-in-part of application No. PCT/US2015/016225, filed on Feb. 17, 2015, which is a continuation-in-part of application No. PCT/US2014/016632, filed on Feb. 14, 2014, application No. 15/235,634, which is a continuation-in-part of application No. 14/763,271, filed as application No. PCT/US2014/016628 on Feb. 14, 2014, now Pat. No. 9,857,076, application No. 15/235,634, which is a continuation-in-part of application No. 15/215,401, filed on Jul. 20, 2016, which is a continuation-in-part of application No. PCT/US2015/012843, filed on Jan. 26, 2015.

(60) Provisional application No. 61/765,022, filed on Feb. 14, 2013, provisional application No. 61/931,407, filed on Jan. 24, 2014.

(51) Int. Cl.
*F23D 14/02* (2006.01)
*F23D 14/14* (2006.01)

(52) U.S. Cl.
CPC ..... *F23D 14/02* (2013.01); *F23D 14/145* (2013.01)

(58) Field of Classification Search
CPC ..... F23D 14/145
USPC ..... 431/75, 46, 90
See application file for complete search history.

(56) References Cited

U.S. PATENT DOCUMENTS 2,095,065 A 10/1937 Hays
2,604,936 A 7/1952 Kaehni et al.
(Continued)

FOREIGN PATENT DOCUMENTS

CN 2484481 4/2002
CN 1950646 4/2007
(Continued)

OTHER PUBLICATIONS

PCT International Search Report and Written Opinion of PCT Application No. PCT/US2015/016225 dated Jun. 8, 2015.
(Continued)

*Primary Examiner* — Avinash A Savani
(74) *Attorney, Agent, or Firm* — Christopher A. Wiklof; David C. Conlee; Launchpad IP, Inc.

(57) ABSTRACT

A method for operating a combustion system includes outputting fuel and oxidant from a fuel and oxidant source onto a perforated flame holder. The method further includes sustaining a combustion reaction of the fuel and oxidant within the perforated flame holder.

37 Claims, 5 Drawing Sheets

(56) References Cited

U.S. PATENT DOCUMENTS 2,635,813 A 4/1953 Schlenz
3,008,513 A 11/1961 Holden
3,076,605 A 2/1963 Holden
3,306,338 A 2/1967 Wright et al.
3,324,924 A 6/1967 Hailstone et al.
3,638,621 A 2/1972 Craig
3,663,154 A 5/1972 Locke
3,848,573 A 11/1974 Phillips
4,021,188 A 5/1977 Yamagishi et al.
4,081,958 A 4/1978 Schelp
4,111,636 A 9/1978 Goldberg
4,195,596 A 4/1980 Scheifley et al.
4,397,356 A 8/1983 Retallick
4,408,461 A 10/1983 Bruhwiler et al.
4,413,976 A * 11/1983 Scherer ..... F23Q 9/045 431/278
4,443,182 A 4/1984 Wojcieson et al.
4,473,349 A 9/1984 Kumatsu
4,483,673 A 11/1984 Murai et al.
4,519,770 A 5/1985 Kesselring
4,588,373 A 5/1986 Tonon et al.
4,627,388 A 12/1986 Buice
4,643,667 A 2/1987 Fleming
4,673,349 A 6/1987 Abe et al.
4,726,767 A 2/1988 Nakajima
4,752,213 A 6/1988 Grochowski et al.
4,773,847 A * 9/1988 Shukla ..... F23D 11/36 136/208
4,850,862 A 7/1989 Bjerklie
5,235,667 A 8/1993 Canfield et al.
5,275,552 A 1/1994 Schwartz et al.
5,326,257 A 7/1994 Taylor et al.
5,375,999 A * 12/1994 Aizawa ..... F23C 13/00 431/170
5,380,192 A 1/1995 Hamos
5,409,375 A 4/1995 Butcher
5,431,557 A 7/1995 Hamos
5,441,402 A 8/1995 Reuther et al.
5,460,512 A 10/1995 Lifshits et al.
5,511,516 A 4/1996 Moore, Jr. et al.
5,641,282 A 6/1997 Lee et al.
5,658,140 A * 8/1997 Kondou ..... F23N 3/082 431/31
5,667,374 A 9/1997 Nutcher et al.
5,718,573 A 2/1998 Knight et al.
5,784,889 A 7/1998 Joos et al.
5,890,886 A 4/1999 Doker et al.
5,899,686 A 5/1999 Carbone et al.
5,957,682 A 9/1999 Kamal et al.
5,993,192 A 11/1999 Schmidt et al.
6,159,001 A 12/2000 Kushch et al.
6,210,151 B1 4/2001 Joshi et al.
6,270,336 B1 8/2001 Terashima et al.
6,287,111 B1 9/2001 Gensler
6,431,856 B1 * 8/2002 Maenishi ..... F23C 6/045 122/4 D
5,499,990 A1 12/2002 Zink et al.
6,752,620 B2 6/2004 Heier et al.
6,997,701 B2 2/2006 Volkert et al.
7,137,808 B2 11/2006 Branston et al.
7,243,496 B2 7/2007 Pavlik et al.
7,360,506 B2 4/2008 Shellenberger et al.
7,410,288 B1 8/2008 Kelso et al.
7,523,603 B2 4/2009 Hagen et al.
8,851,882 B2 10/2014 Hartwick et al.
8,881,535 B2 11/2014 Hartwick et al.
8,911,699 B2 12/2014 Colannino et al.
9,151,549 B2 10/2015 Goodson et al.
9,209,654 B2 12/2015 Colannino et al.
9,243,800 B2 1/2016 Goodson et al.
9,267,680 B2 2/2016 Goodson et al.
9,284,886 B2 3/2016 Breidenthal et al.
9,289,780 B2 3/2016 Goodson
9,310,077 B2 4/2016 Breidenthal et al.
9,366,427 B2 6/2016 Sonnichsen et al.
9,371,994 B2 6/2016 Goodson et al.
9,377,188 B2 6/2016 Ruiz et al.
9,377,189 B2 6/2016 Ruiz et al.
9,377,190 B2 6/2016 Karkow et al.
9,377,195 B2 6/2016 Goodson et al.
9,388,981 B2 7/2016 Karkow et al.
2001/0046649 A1 11/2001 Schutz et al.
2002/0155403 A1 10/2002 Griffin et al.
2002/0197574 A1 12/2002 Jones et al.
2003/0054313 A1 * 3/2003 Rattner ..... F23D 14/16 431/326
2004/0058290 A1 3/2004 Mauzey et al.
2004/0081933 A1 4/2004 St. Charles et al.
2004/0197719 A1 10/2004 Chung et al.
2004/0224268 A1 11/2004 Keller et al.
2005/0106520 A1 5/2005 Cornwell et al.
2005/0208442 A1 9/2005 Heiligers et al.
2006/0008755 A1 1/2006 Leinemann et al.
2006/0084017 A1 4/2006 Huebner et al.
2006/0141413 A1 6/2006 Masten et al.
2006/0292510 A1 12/2006 Krauklis et al.
2008/0124666 A1 5/2008 Stocker et al.
2008/0131824 A1 6/2008 Wahl et al.
2009/0053664 A1 2/2009 Staller et al.
2010/0077731 A1 4/2010 Jeong et al.
2010/0126175 A1 5/2010 Kim et al.
2010/0178219 A1 7/2010 Verykios et al.
2011/0076628 A1 3/2011 Miura et al.
2011/0076629 A1 3/2011 Mosiewicz
2012/0064465 A1 3/2012 Borissov et al.
2012/0164590 A1 6/2012 Mach
2012/0231398 A1 9/2012 Carpentier et al.
2013/0230810 A1 9/2013 Goodson et al.
2013/0260321 A1 10/2013 Colannino et al.
2013/0323655 A1 12/2013 Krichtafovitch et al.
2013/0323661 A1 12/2013 Goodson et al.
2013/0333279 A1 12/2013 Osler et al.
2013/0336352 A1 12/2013 Colannino et al.
2014/0051030 A1 2/2014 Colannino et al.
2014/0065558 A1 3/2014 Colannino et al.
2014/0080070 A1 3/2014 Krichtafovitch et al.
2014/0162195 A1 6/2014 Lee et al.
2014/0162196 A1 6/2014 Krichtafovitch et al.
2014/0162197 A1 6/2014 Krichtafovitch et al.
2014/0162198 A1 6/2014 Krichtafovitch et al.
2014/0170569 A1 6/2014 Anderson et al.
2014/0170571 A1 6/2014 Casasanta, III et al.
2014/0170575 A1 6/2014 Krichtafovitch
2014/0170576 A1 6/2014 Colannino et al.
2014/0170577 A1 6/2014 Colannino et al.
2014/0186778 A1 7/2014 Colannino et al.
2014/0196368 A1 7/2014 Wiklof
2014/0196369 A1 7/2014 Wiklof
2014/0208758 A1 7/2014 Breidenthal et al.
2014/0212820 A1 7/2014 Colannino et al.
2014/0216401 A1 8/2014 Colannino et al.
2014/0227645 A1 8/2014 Krichtafovitch et al.
2014/0227646 A1 8/2014 Krichtafovitch et al.
2014/0227649 A1 8/2014 Krichtafovitch et al.
2014/0248566 A1 9/2014 Krichtafovitch et al.
2014/0255855 A1 9/2014 Krichtafovitch
2014/0255856 A1 9/2014 Colannino et al.
2014/0272730 A1 9/2014 Krichtafovitch et al.
2014/0272731 A1 9/2014 Breidenthal et al.
2014/0287368 A1 9/2014 Krichtafovitch et al.
2014/0295094 A1 10/2014 Casasanta, III
2014/0295360 A1 10/2014 Wiklof
2014/0335460 A1 11/2014 Wiklof et al.
2015/0079524 A1 3/2015 Colannino et al.
2015/0104748 A1 4/2015 Dumas et al.
2015/0107260 A1 4/2015 Colannino et al.
2015/0118629 A1 4/2015 Colannino et al.
2015/0121890 A1 5/2015 Colannino et al.
2015/0140498 A1 5/2015 Colannino
2015/0147704 A1 5/2015 Krichtafovitch et al.
2015/0147705 A1 5/2015 Colannino et al.
2015/0147706 A1 5/2015 Krichtafovitch et al.
2015/0219333 A1 8/2015 Colannino et al.

(56) References Cited

U.S. PATENT DOCUMENTS

| | | | |
|---|---|---|---|
| 2015/0226424 | A1 | 8/2015 | Breidenthal et al. |
| 2015/0241057 | A1 | 8/2015 | Krichtafovitch et al. |
| 2015/0276211 | A1 | 10/2015 | Colannino et al. |
| 2015/0276212 | A1 | 10/2015 | Karkow et al. |
| 2015/0276213 | A1 | 10/2015 | Karkow et al. |
| 2015/0276217 | A1 | 10/2015 | Karkow et al. |
| 2015/0276220 | A1 | 10/2015 | Karkow et al. |
| 2015/0285491 | A1 | 10/2015 | Karkow et al. |
| 2015/0316261 | A1 | 11/2015 | Karkow et al. |
| 2015/0330625 | A1 | 11/2015 | Karkow et al. |
| 2015/0338089 | A1 | 11/2015 | Krichtafovitch et al. |
| 2015/0345780 | A1 | 12/2015 | Krichtafovitch |
| 2015/0345781 | A1 | 12/2015 | Krichtafovitch et al. |
| 2015/0362177 | A1 | 12/2015 | Krichtafovitch et al. |
| 2015/0362178 | A1 | 12/2015 | Karkow et al. |
| 2015/0369476 | A1 | 12/2015 | Wiklof |
| 2015/0369477 | A1 | 12/2015 | Karkow et al. |
| 2016/0003471 | A1 | 1/2016 | Karkow et al. |
| 2016/0018103 | A1 | 1/2016 | Karkow et al. |
| 2016/0025333 | A1 | 1/2016 | Karkow et al. |
| 2016/0025374 | A1 | 1/2016 | Karkow et al. |
| 2016/0025380 | A1 | 1/2016 | Karkow et al. |
| 2016/0033125 | A1 | 2/2016 | Krichtafovitch et al. |
| 2016/0040872 | A1 | 2/2016 | Colannino et al. |
| 2016/0046524 | A1 | 2/2016 | Colannino et al. |
| 2016/0047542 | A1 | 2/2016 | Wiklof et al. |
| 2016/0091200 | A1 | 3/2016 | Colannino et al. |
| 2016/0109118 | A1 | 4/2016 | Krichtafovitch et al. |
| 2016/0123576 | A1 | 5/2016 | Colannino et al. |
| 2016/0123577 | A1 | 5/2016 | Dumas et al. |
| 2016/0138799 | A1 | 5/2016 | Colannino et al. |
| 2016/0138800 | A1 | 5/2016 | Anderson et al. |
| 2016/0161110 | A1 | 6/2016 | Krichtafovitch et al. |
| 2016/0161115 | A1 | 6/2016 | Krichtafovitch et al. |
| 2016/0215974 | A1 | 7/2016 | Wiklof |
| 2016/0230984 | A1 | 8/2016 | Colannino et al. |
| 2017/0010019 | A1 | 1/2017 | Karkow et al. |

FOREIGN PATENT DOCUMENTS

| | | |
|---|---|---|
| CN | 101294714 | 10/2008 |
| CN | 201203123 | 3/2009 |
| CN | 101556040 | 10/2009 |
| CN | 202182470 | 4/2012 |
| DE | 10 2009 028624 | 2/2011 |
| EP | 0223691 | 5/1987 |
| EP | 0478305 | 12/1997 |
| EP | 0844434 | 5/1998 |
| EP | 1916477 | 4/2008 |
| EP | 2738460 | 6/2014 |
| GB | 2456861 | 7/2009 |
| JP | 60-073242 | 4/1985 |
| JP | 06-026624 | 2/1994 |
| JP | H 07-48136 | 2/1995 |
| JP | 07-083076 | 3/1995 |
| JP | 2006-275482 | 10/2006 |
| WO | WO 1995/000803 | 1/1995 |
| WO | WO 2012/109499 | 8/2012 |
| WO | WO 2013/181569 | 12/2013 |
| WO | WO 2014/127305 | 8/2014 |
| WO | WO 2014/127307 | 8/2014 |
| WO | WO 2014/127311 | 8/2014 |
| WO | WO 2014/160836 | 10/2014 |
| WO | WO 2014/183135 | 11/2014 |
| WO | WO 2015/017084 | 2/2015 |
| WO | WO 2015/038245 | 3/2015 |
| WO | WO 2015/042566 | 3/2015 |
| WO | WO 2015/042613 | 3/2015 |
| WO | WO 2015/042614 | 3/2015 |
| WO | WO 2015/042615 | 3/2015 |
| WO | WO 2015/051136 | 4/2015 |
| WO | WO 2015/054323 | 4/2015 |
| WO | WO 2015/057740 | 4/2015 |
| WO | WO 2015/061760 | 4/2015 |
| WO | WO 2015/070188 | 5/2015 |
| WO | WO 2015/089306 | 6/2015 |
| WO | WO 2015/103436 | 7/2015 |
| WO | WO 2015/112950 | 7/2015 |
| WO | WO 2015/123149 | 8/2015 |
| WO | WO 2015/123381 | 8/2015 |
| WO | WO 2015/123670 | 8/2015 |
| WO | WO 2015/123683 | 8/2015 |
| WO | WO 2015/123694 | 8/2015 |
| WO | WO 2015/123696 | 8/2015 |
| WO | WO 2015/123701 | 8/2015 |
| WO | WO 2016/003883 | 1/2016 |
| WO | WO 2016/007564 | 1/2016 |
| WO | WO 2016/018610 | 2/2016 |
| WO | WO 2016/105489 | 6/2016 |

OTHER PUBLICATIONS

PCT International Search Report and Written Opinion of PCT Application No. PCT/US2014/016632 dated May 26, 2014.

PCT International Search Report and Written Opinion of PCT Application No. PCT/US2014/016628 dated May 27, 2014.

PCT International Search Report and Written Opinion of PCT Application No. PCT/US2015/012843 dated May 7, 2015.

Arnold Schwarzenegger, "A Low NOx Porous Ceramics Burner Performance Study," California Energy Commission Public Interest Energy Research Program, Dec. 2007, San Diego State University Foundation, p. 5.

Howell, J.R., et al.; "Combustion of Hydrocarbon Fuels Within Porous Inert Media," Dept. of Mechanical Engineering, The University of Texas at Austin. Prog. Energy Combust. Sci., 1996, vol. 22, p. 121-145.

Li, Youjia, "Coal Gas Burner," China Industry Press, Mar. 31, 1996, pp. 84-87.

EPO Extended Search Report and Search Opinion of EP Application No. 14752076.1 dated Oct. 27, 2016.

Fric, Thomas F., "Effects of Fuel-Air Unmixedness of NOx Emissions," Sep.-Oct. 1993. Journal of Propulsion and Power, vol. 9, No. 5, pp. 708-713.

EPO Extended Search Report and Search Opinion of EP Application No. 15739931.2 dated Sep. 21, 2017.

M. Abdul Mujeebu et al., "Applications of Porous Media Combustion Technology—A Review." Applied Energy 86, 2009, pp. 1365-1375.

EPO Extended Search Report and Search Opinion of EP Application No. 15749426.1 dated Dec. 15, 2017.

PCT International Search Report and Written Opinion of PCT/US2014/057075 dated Jan. 14, 2015.

PCT International Search Report and Written Opinion of PCT/US2014/016622 dated May 27, 2014.

* cited by examiner

METHOD FOR OPERATING A COMBUSTION SYSTEM INCLUDING A PERFORATED FLAME HOLDER

CROSS REFERENCE TO RELATED APPLICATIONS

The present application is a U.S. Continuation-in-Part Application which claims priority benefit under 35 U.S.C. § 120 (pre-AIA) of co-pending International Patent Application No. PCT/US2015/016225, entitled "METHOD FOR OPERATING A COMBUSTION SYSTEM INCLUDING A PERFORATED FLAME HOLDER," filed Feb. 17, 2015. Co-pending International Patent Application No. PCT/US2015/016225 claims priority to International Application No. PCT/US2014/016632, entitled "FUEL COMBUSTION SYSTEM WITH A PERFORATED REACTION HOLDER," filed Feb. 14, 2014. The present application is also a Continuation-in-Part of co-pending U.S. patent application Ser. No. 14/763,271, entitled "PERFORATED FLAME HOLDER AND BURNER INCLUDING A PERFORATED FLAME HOLDER," filed Jul. 24, 2015. Co-pending U.S. patent application Ser. No. 14/763,271 claims priority benefit to International Patent Application No. PCT/US2014/016628, entitled "PERFORATED FLAME HOLDER AND BURNER INCLUDING A PERFORATED FLAME HOLDER," filed Feb. 14, 2014. International Patent Application No. PCT/US2014/016628 claims the benefit of U.S. Provisional Patent Application No. 61/765,022, entitled "PERFORATED FLAME HOLDER AND BURNER INCLUDING A PERFORATED FLAME HOLDER," filed Feb. 14, 2013. The present application is also a Continuation-in-Part of co-pending U.S. patent application Ser. No. 15/215,401, entitled "LOW $NO_x$ FIRE TUBE BOILER," filed Jul. 20, 2016. Co-pending U.S. patent application Ser. No. 15/215,401 claims priority benefit to International Patent Application No. PCT/US2015/012843, entitled "LOW $NO_x$ FIRE TUBE BOILER," filed Jan. 26, 2015. International Patent Application No. PCT/US2015/012843 claims the benefit of U.S. Provisional Patent Application No. 61/931,407, entitled "LOW $NO_x$ FIRE TUBE BOILER," filed Jan. 24, 2014. Each of the international patent applications, U.S. patent applications, and U.S. provisional patent applications listed in this paragraph are, to the extent not inconsistent with the disclosure herein, incorporated by reference.

SUMMARY

One embodiment is a method for operating a combustion system that includes a fuel and oxidant source and a perforated flame holder positioned to receive fuel and oxidant from the fuel and oxidant source. The method includes outputting fuel and oxidant from the fuel and oxidant source, receiving the fuel and oxidant at the perforated flame holder, and sustaining a combustion reaction of the fuel and oxidant within the perforated flame holder.

DETAILED DESCRIPTION

Figure 1:
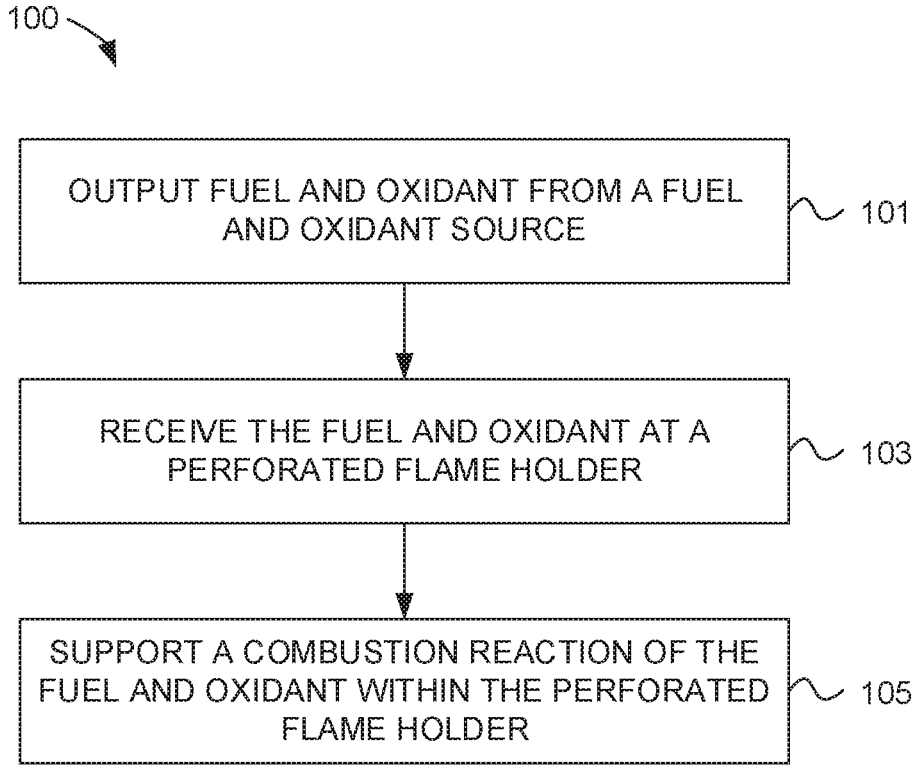
FIG. 1 is a flow diagram of a process for operating a combustion system including a perforated flame holder, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1 is a flow diagram of a process 100 for operating a combustion system including a perforated flame holder, according to an embodiment. At 101, fuel and oxidant is output from the fuel and oxidant source. At 103, the fuel and oxidant is received at a perforated flame holder positioned to receive the fuel and oxidant from the fuel and oxidant source. At 105, a combustion reaction of the fuel and oxidant is supported within the perforated flame holder.

According to an embodiment, the perforated flame holder includes an input surface, an output surface, and a plurality of perforations extending between the input surface and the output surface.

According to an embodiment, the perforated flame holder receives the fuel and oxidant into the perforations. The perforated flame holder supports a majority of the combustion reaction within the perforations. According to an embodiment, the perforated flame holder supports 80% or more of the combustion reaction of the fuel and oxidant within the perforated flame holder.

Figure 2:
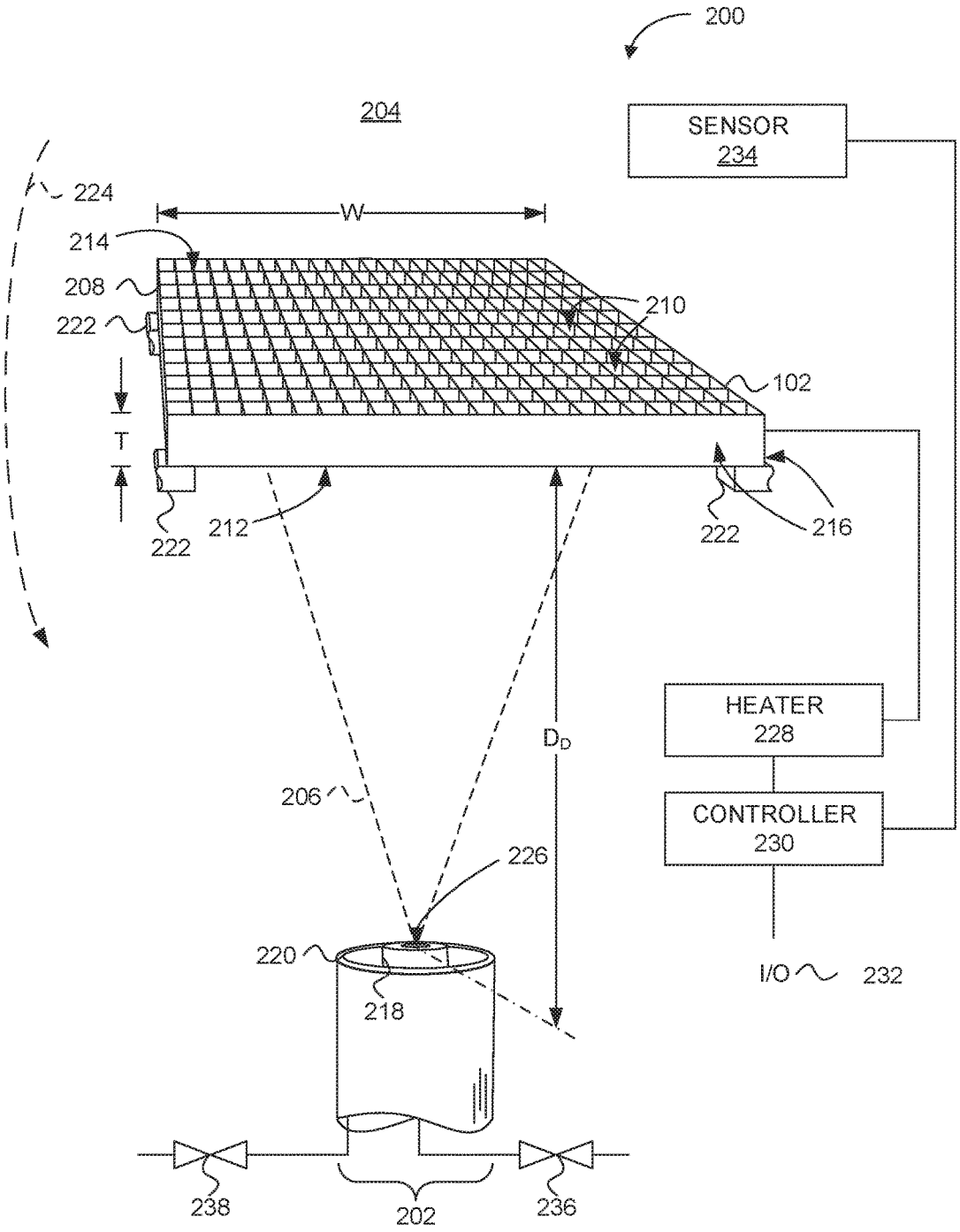
FIG. 2 is a simplified perspective view of a burner system including a perforated flame holder, according to an embodiment.

FIG. 2 is a simplified diagram of a burner system 200 including a perforated flame holder 102 configured to hold a combustion reaction, according to an embodiment. As used herein, the terms perforated flame holder, perforated reaction holder, porous flame holder, porous reaction holder, duplex, and duplex tile shall be considered synonymous unless further definition is provided.

Experiments performed by the inventors have shown that perforated flame holders 102 described herein can support very clean combustion. Specifically, in experimental use of systems 200 ranging from pilot scale to full scale, output of oxides of nitrogen (NOx) was measured to range from low single digit parts per million (ppm) down to undetectable (less than 1 ppm) concentration of NOx at the stack. These remarkable results were measured at 3% (dry) oxygen ($O_2$) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 200 includes a fuel and oxidant source 202 disposed to output fuel and oxidant into a combustion volume 204 to form a fuel and oxidant mixture 206. As used herein, the terms fuel and oxidant mixture and fuel stream may be used interchangeably and considered synonymous depending on the context, unless further definition is provided. As used herein, the terms combustion volume, combustion chamber, furnace volume, and the like shall be considered synonymous unless further definition is provided. The perforated flame holder 102 is disposed in the combustion volume 204 and positioned to receive the fuel and oxidant mixture 206.

Figure 3:
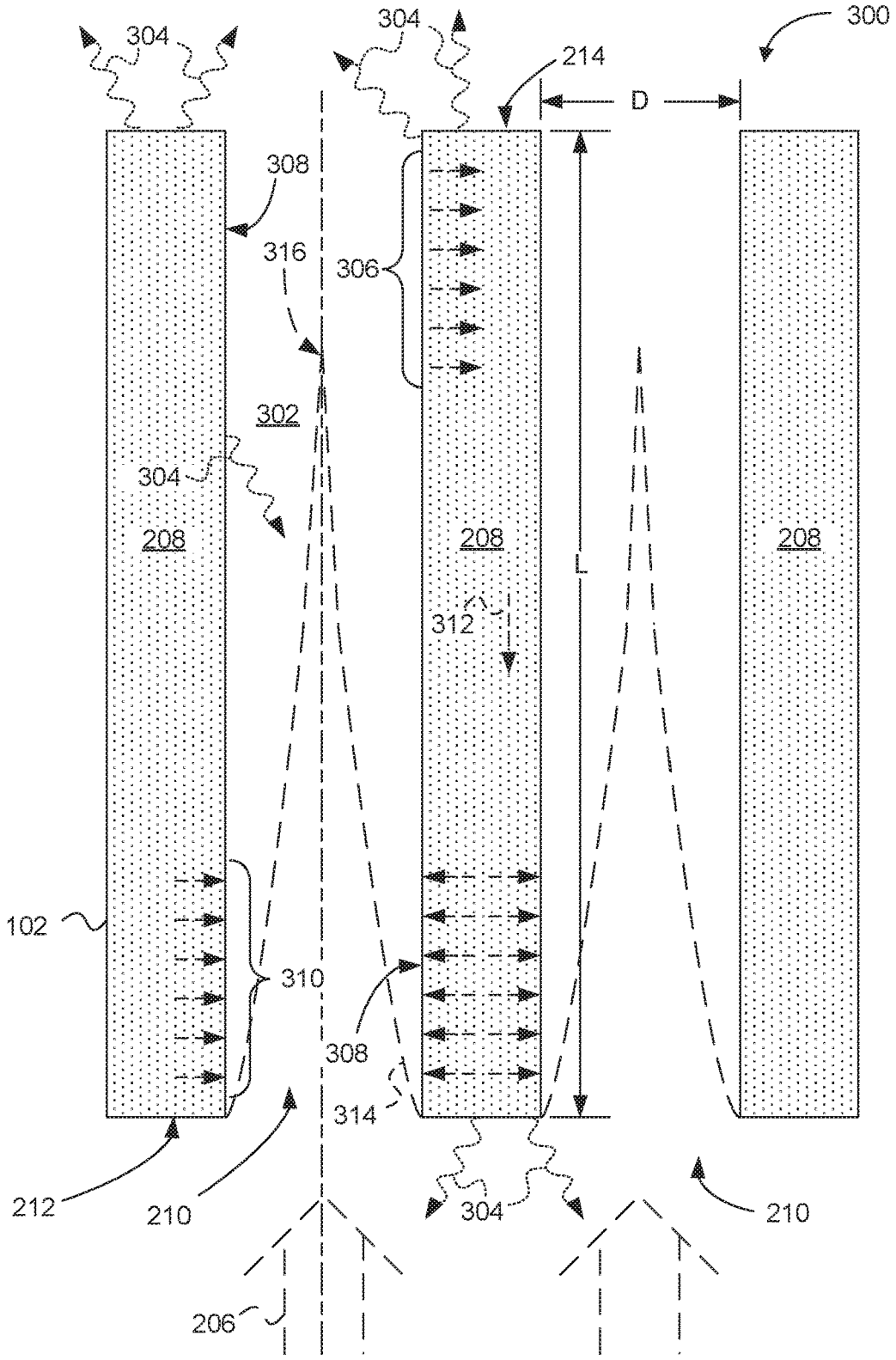
FIG. 3 is a side sectional diagram of a portion of the perforated flame holder of FIG. 2, according to an embodiment.

FIG. 3 is a side sectional diagram 300 of a portion of the perforated flame holder 102 of FIGS. 1 and 2, according to an embodiment. Referring to FIGS. 2 and 3, the perforated flame holder 102 includes a perforated flame holder body 208 defining a plurality of perforations 210 aligned to receive the fuel and oxidant mixture 206 from the fuel and oxidant source 202. As used herein, the terms perforation, pore, aperture, elongated aperture, and the like, in the context of the perforated flame holder 102, shall be considered synonymous unless further definition is provided. The perforations 210 are configured to collectively hold a combustion reaction 302 supported by the fuel and oxidant mixture 206.

The fuel can include hydrogen, a hydrocarbon gas, a vaporized hydrocarbon liquid, an atomized hydrocarbon liquid, or a powdered or pulverized solid. The fuel can be a single species or can include a mixture of gas(es), vapor(s), atomized liquid(s), and/or pulverized solid(s). For example, in a process heater application the fuel can include fuel gas or byproducts from the process that include carbon monoxide (CO), hydrogen ($H_2$), and methane ($CH_4$). In another application the fuel can include natural gas (mostly $CH_4$) or propane ($C_3H_8$). In another application, the fuel can include #2 fuel oil or #6 fuel oil. Dual fuel applications and flexible fuel applications are similarly contemplated by the inventors. The oxidant can include oxygen carried by air, flue gas, and/or can include another oxidant, either pure or carried by a carrier gas. The terms oxidant and oxidizer shall be considered synonymous herein.

According to an embodiment, the perforated flame holder body 208 can be bounded by an input face 212 disposed to receive the fuel and oxidant mixture 206, an output face 214 facing away from the fuel and oxidant source 202, and a peripheral surface 216 defining a lateral extent of the perforated flame holder 102. The plurality of perforations 210 which are defined by the perforated flame holder body 208 extend from the input face 212 to the output face 214. The plurality of perforations 210 can receive the fuel and oxidant mixture 206 at the input face 212. The fuel and oxidant mixture 206 can then combust in or near the plurality of perforations 210 and combustion products can exit the plurality of perforations 210 at or near the output face 214.

According to an embodiment, the perforated flame holder 102 is configured to hold a majority of the combustion reaction 302 within the perforations 210. For example, on a steady-state basis, more than half the molecules of fuel output into the combustion volume 204 by the fuel and oxidant source 202 may be converted to combustion products between the input face 212 and the output face 214 of the perforated flame holder 102. According to an alternative interpretation, more than half of the heat or thermal energy output by the combustion reaction 302 may be output between the input face 212 and the output face 214 of the perforated flame holder 102. As used herein, the terms heat, heat energy, and thermal energy shall be considered synonymous unless further definition is provided. As used above, heat energy and thermal energy refer generally to the released chemical energy initially held by reactants during the combustion reaction 302. As used elsewhere herein, heat, heat energy and thermal energy correspond to a detectable temperature rise undergone by real bodies characterized by heat capacities. Under nominal operating conditions, the perforations 210 can be configured to collectively hold at least 80% of the combustion reaction 302 between the input face 212 and the output face 214 of the perforated flame holder 102. In some experiments, the inventors produced a combustion reaction 302 that was apparently wholly contained in the perforations 210 between the input face 212 and the output face 214 of the perforated flame holder 102. According to an alternative interpretation, the perforated flame holder 102 can support combustion between the input face 212 and output face 214 when combustion is "time-averaged." For example, during transients, such as before the perforated flame holder 102 is fully heated, or if too high a (cooling) load is placed on the system, the combustion may travel somewhat downstream from the output face 214 of the perforated flame holder 102. Alternatively, if the cooling load is relatively low and/or the furnace temperature reaches a high level, the combustion may travel somewhat upstream of the input face 212 of the perforated flame holder 102.

While a "flame" is described in a manner intended for ease of description, it should be understood that in some instances, no visible flame is present. Combustion occurs primarily within the perforations 210, but the "glow" of combustion heat is dominated by a visible glow of the perforated flame holder 102 itself. In other instances, the inventors have noted transient "huffing" or "flashback" wherein a visible flame momentarily ignites in a region lying between the input face 212 of the perforated flame holder 102 and the fuel nozzle 218, within the dilution region $D_D$. Such transient huffing or flashback is generally short in duration such that, on a time-averaged basis, a majority of combustion occurs within the perforations 210 of the perforated flame holder 102, between the input face 212 and the output face 214. In still other instances, the inventors have noted apparent combustion occurring downstream from the output face 214 of the perforated flame holder 102, but still a majority of combustion occurred within the perforated flame holder 102 as evidenced by continued visible glow from the perforated flame holder 102 that was observed.

The perforated flame holder 102 can be configured to receive heat from the combustion reaction 302 and output a portion of the received heat as thermal radiation 304 to heat-receiving structures (e.g., furnace walls and/or radiant section working fluid tubes) in or adjacent to the combustion volume 204. As used herein, terms such as radiation, thermal radiation, radiant heat, heat radiation, etc. are to be construed as being substantially synonymous, unless further definition is provided. Specifically, such terms refer to blackbody-type radiation of electromagnetic energy, primarily at infrared wavelengths, but also at visible wavelengths owing to elevated temperature of the perforated flame holder body 208.

Referring especially to FIG. 3, the perforated flame holder 102 outputs another portion of the received heat to the fuel and oxidant mixture 206 received at the input face 212 of the perforated flame holder 102. The perforated flame holder body 208 may receive heat from the combustion reaction 302 at least in heat receiving regions 306 of perforation walls 308. Experimental evidence has suggested to the inventors that the position of the heat receiving regions 306, or at least the position corresponding to a maximum rate of receipt of heat, can vary along the length of the perforation walls 308. In some experiments, the location of maximum receipt of heat was apparently between ⅓ and ½ of the distance from the input face 212 to the output face 214 (i.e., somewhat nearer to the input face 212 than to the output face 214). The inventors contemplate that the heat receiving regions 306 may lie nearer to the output face 214 of the perforated flame holder 102 under other conditions. Most probably, there is no clearly defined edge of the heat receiving regions 306 (or for that matter, the heat output regions 310, described below). For ease of understanding, the heat receiving regions 306 and the heat output regions 310 will be described as particular regions 306, 310.

The perforated flame holder body 208 can be characterized by a heat capacity. The perforated flame holder body 208 may hold thermal energy from the combustion reaction 302 in an amount corresponding to the heat capacity multiplied by temperature rise, and transfer the thermal energy from the heat receiving regions 306 to heat output regions 310 of the perforation walls 308. Generally, the heat output regions 310 are nearer to the input face 212 than are the heat receiving regions 306. According to one interpretation, the perforated flame holder body 208 can transfer heat from the heat receiving regions 306 to the heat output regions 310 via thermal radiation, depicted graphically as 304. According to another interpretation, the perforated flame holder body 208 can transfer heat from the heat receiving regions 306 to the heat output regions 310 via heat conduction along heat conduction paths 312. The inventors contemplate that multiple heat transfer mechanisms including conduction, radiation, and possibly convection may be operative in transferring heat from the heat receiving regions 306 to the heat output regions 310. In this way, the perforated flame holder 102 may act as a heat source to maintain the combustion reaction 302, even under conditions where a combustion reaction 302 would not be stable when supported from a conventional flame holder.

The inventors believe that the perforated flame holder 102 causes the combustion reaction 302 to begin within thermal boundary layers 314 formed adjacent to walls 308 of the perforations 210. Insofar as combustion is generally understood to include a large number of individual reactions, and since a large portion of combustion energy is released within the perforated flame holder 102, it is apparent that at least a majority of the individual reactions occur within the perforated flame holder 102. As the relatively cool fuel and oxidant mixture 206 approaches the input face 212, the flow is split into portions that respectively travel through individual perforations 210. The hot perforated flame holder body 208 transfers heat to the fluid, notably within thermal boundary layers 314 that progressively thicken as more and more heat is transferred to the incoming fuel and oxidant mixture 206. After reaching a combustion temperature (e.g., the auto-ignition temperature of the fuel), the reactants continue to flow while a chemical ignition delay time elapses, over which time the combustion reaction 302 occurs. Accordingly, the combustion reaction 302 is shown as occurring within the thermal boundary layers 314. As flow progresses, the thermal boundary layers 314 merge at a merger point 316. Ideally, the merger point 316 lies between the input face 212 and output face 214 that define the ends of the perforations 210. At some position along the length of a perforation 210, the combustion reaction 302 outputs more heat to the perforated flame holder body 208 than it receives from the perforated flame holder body 208. The heat is received at the heat receiving region 306, is held by the perforated flame holder body 208, and is transported to the heat output region 310 nearer to the input face 212, where the heat is transferred into the cool reactants (and any included diluent) to bring the reactants to the ignition temperature.

In an embodiment, each of the perforations 210 is characterized by a length L defined as a reaction fluid propagation path length between the input face 212 and the output face 214 of the perforated flame holder 102. As used herein, the term reaction fluid refers to matter that travels through a perforation 210. Near the input face 212, the reaction fluid includes the fuel and oxidant mixture 206 (optionally including nitrogen, flue gas, and/or other "non-reactive" species). Within the combustion reaction region, the reaction fluid may include plasma associated with the combustion reaction 302, molecules of reactants and their constituent parts, any non-reactive species, reaction intermediates (including transition states), and reaction products. Near the output face 214, the reaction fluid may include reaction products and byproducts, non-reactive gas, and excess oxidant.

The plurality of perforations 210 can be each characterized by a transverse dimension D between opposing perforation walls 308. The inventors have found that stable combustion can be maintained in the perforated flame holder 102 if the length L of each perforation 210 is at least four times the transverse dimension D of the perforation. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for thermal boundary layers 314 to form adjacent to the perforation walls 308 in a reaction fluid flowing through the perforations 210 to converge at merger points 316 within the perforations 210 between the input face 212 and the output face 214 of the perforated flame holder 102. In experiments, the inventors have found L/D ratios between 12 and 48 to work well (i.e., produce low NOx, produce low CO, and maintain stable combustion).

The perforated flame holder body 208 can be configured to convey heat between adjacent perforations 210. The heat conveyed between adjacent perforations 210 can be selected to cause heat output from the combustion reaction portion 302 in a first perforation 210 to supply heat to stabilize a combustion reaction portion 302 in an adjacent perforation 210.

Referring especially to FIG. 2, the fuel and oxidant source 202 can further include a fuel nozzle 218, configured to output fuel, and an oxidant source 220 configured to output a fluid including the oxidant. For example, the fuel nozzle 218 can be configured to output pure fuel. The oxidant source 220 can be configured to output combustion air carrying oxygen, and optionally, flue gas.

The perforated flame holder 102 can be held by a perforated flame holder support structure 222 configured to hold the perforated flame holder 102 at a dilution distance $D_D$ away from the fuel nozzle 218. The fuel nozzle 218 can be configured to emit a fuel jet selected to entrain the oxidant to form the fuel and oxidant mixture 206 as the fuel jet and oxidant travel along a path to the perforated flame holder 102 through the dilution distance $D_D$ between the fuel nozzle 218 and the perforated flame holder 102. Additionally or alternatively (particularly when a blower is used to deliver oxidant contained in combustion air), the oxidant or combustion air source can be configured to entrain the fuel and the fuel and oxidant travel through the dilution distance $D_D$. In some embodiments, a flue gas recirculation path 224 can be provided. Additionally or alternatively, the fuel nozzle 218 can be configured to emit a fuel jet selected to entrain the oxidant and to entrain flue gas as the fuel jet travels through the dilution distance $D_D$ between the fuel nozzle 218 and the input face 212 of the perforated flame holder 102.

The fuel nozzle 218 can be configured to emit the fuel through one or more fuel orifices 226 having an inside diameter dimension that is referred to as "nozzle diameter." The perforated flame holder support structure 222 can support the perforated flame holder 102 to receive the fuel and oxidant mixture 206 at the distance $D_D$ away from the fuel nozzle 218 greater than 20 times the nozzle diameter. In another embodiment, the perforated flame holder 102 is disposed to receive the fuel and oxidant mixture 206 at the distance $D_D$ away from the fuel nozzle 218 between 100 times and 1100 times the nozzle diameter. Preferably, the perforated flame holder support structure 222 is configured to hold the perforated flame holder 102 at a distance about 200 times or more of the nozzle diameter away from the fuel nozzle 218. When the fuel and oxidant mixture 206 travels about 200 times the nozzle diameter or more, the mixture is sufficiently homogenized to cause the combustion reaction 302 to produce minimal NOx.

The fuel and oxidant source 202 can alternatively include a premix fuel and oxidant source, according to an embodiment. A premix fuel and oxidant source can include a premix chamber (not shown), a fuel nozzle configured to output fuel into the premix chamber, and an oxidant (e.g., combustion air) channel configured to output the oxidant into the premix chamber. A flame arrestor can be disposed between the premix fuel and oxidant source and the perforated flame holder 102 and be configured to prevent flame flashback into the premix fuel and oxidant source.

The oxidant source 220, whether configured for entrainment in the combustion volume 204 or for premixing, can include a blower configured to force the oxidant through the fuel and oxidant source 202.

The support structure 222 can be configured to support the perforated flame holder 102 from a floor or wall (not shown) of the combustion volume 204, for example. In another embodiment, the support structure 222 supports the perforated flame holder 102 from the fuel and oxidant source 202. Alternatively, the support structure 222 can suspend the perforated flame holder 102 from an overhead structure (such as a flue, in the case of an up-fired system). The support structure 222 can support the perforated flame holder 102 in various orientations and directions.

The perforated flame holder 102 can include a single perforated flame holder body 208. In another embodiment, the perforated flame holder 102 can include a plurality of adjacent perforated flame holder sections that collectively provide a tiled perforated flame holder 102.

The perforated flame holder support structure 222 can be configured to support the plurality of perforated flame holder sections. The perforated flame holder support structure 222 can include a metal superalloy, a cementatious, and/or ceramic refractory material. In an embodiment, the plurality of adjacent perforated flame holder sections can be joined with a fiber reinforced refractory cement.

The perforated flame holder 102 can have a width dimension W between opposite sides of the peripheral surface 216 at least twice a thickness dimension T between the input face 212 and the output face 214. In another embodiment, the perforated flame holder 102 can have a width dimension W between opposite sides of the peripheral surface 216 at least three times, at least six times, or at least nine times the thickness dimension T between the input face 212 and the output face 214 of the perforated flame holder 102.

In an embodiment, the perforated flame holder 102 can have a width dimension W less than a width of the combustion volume 204. This can allow the flue gas circulation path 224 from above to below the perforated flame holder 102 to lie between the peripheral surface 216 of the perforated flame holder 102 and the combustion volume wall (not shown).

Referring again to both FIGS. 2 and 3, the perforations 210 can be of various shapes. In an embodiment, the perforations 210 can include elongated squares, each having a transverse dimension D between opposing sides of the squares. In another embodiment, the perforations 210 can include elongated hexagons, each having a transverse dimension D between opposing sides of the hexagons. In yet another embodiment, the perforations 210 can include hollow cylinders, each having a transverse dimension D corresponding to a diameter of the cylinder. In another embodiment, the perforations 210 can include truncated cones or truncated pyramids (e.g., frustums), each having a transverse dimension D radially symmetric relative to a length axis that extends from the input face 212 to the output face 214. In some embodiments, the perforations 210 can each have a lateral dimension D equal to or greater than a quenching distance of the flame based on standard reference conditions. Alternatively, the perforations 210 may have lateral dimension D less then than a standard reference quenching distance.

In one range of embodiments, each of the plurality of perforations 210 has a lateral dimension D between 0.05 inch and 1.0 inch. Preferably, each of the plurality of perforations 210 has a lateral dimension D between 0.1 inch and 0.5 inch. For example the plurality of perforations 210 can each have a lateral dimension D of about 0.2 to 0.4 inch.

The void fraction of a perforated flame holder 102 is defined as the total volume of all perforations 210 in a section of the perforated flame holder 102 divided by a total volume of the perforated flame holder 102 including body 208 and perforations 210. The perforated flame holder 102 should have a void fraction between 0.10 and 0.90. In an embodiment, the perforated flame holder 102 can have a void fraction between 0.30 and 0.80. In another embodiment, the perforated flame holder 102 can have a void fraction of about 0.70. Using a void fraction of about 0.70 was found to be especially effective for producing very low NOx.

The perforated flame holder 102 can be formed from a fiber reinforced cast refractory material and/or a refractory material such as an aluminum silicate material. For example, the perforated flame holder 102 can be formed to include mullite or cordierite. Additionally or alternatively, the perforated flame holder body 208 can include a metal superalloy such as Inconel or Hastelloy. The perforated flame holder body 208 can define a honeycomb. Honeycomb is an industrial term of art that need not strictly refer to a hexagonal cross section and most usually includes cells of square cross section. Honeycombs of other cross sectional areas are also known.

The inventors have found that the perforated flame holder 102 can be formed from VERSAGRID® ceramic honeycomb, available from Applied Ceramics, Inc. of Doraville, S.C.

The perforations 210 can be parallel to one another and normal to the input and output faces 212, 214. In another embodiment, the perforations 210 can be parallel to one another and formed at an angle relative to the input and output faces 212, 214. In another embodiment, the perforations 210 can be non-parallel to one another. In another embodiment, the perforations 210 can be non-parallel to one another and non-intersecting. In another embodiment, the perforations 210 can be intersecting. The body 308 can be one piece or can be formed from a plurality of sections.

In another embodiment, which is not necessarily preferred, the perforated flame holder 102 may be formed from reticulated ceramic material. The term "reticulated" refers to a netlike structure. Reticulated ceramic material is often made by dissolving a slurry into a sponge of specified porosity, allowing the slurry to harden, and burning away the sponge and curing the ceramic.

In another embodiment, which is not necessarily preferred, the perforated flame holder 102 may be formed from a ceramic material that has been punched, bored or cast to create channels.

In another embodiment, the perforated flame holder 102 can include a plurality of tubes or pipes bundled together. The plurality of perforations 210 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated flame holder body 208 can alternatively include stacked perforated sheets of material, each sheet having openings that connect with openings of subjacent and superjacent sheets. The perforated sheets can include perforated metal sheets, ceramic sheets and/or expanded sheets. In another embodiment, the perforated flame holder body 208 can include discontinuous packing bodies such that the perforations 210 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic Raschig ring, ceramic Berl saddles, ceramic Intalox saddles, and/or metal rings or other shapes (e.g. Super Raschig Rings) that may be held together by a metal cage. The inventors contemplate various explanations for why burner systems including the perforated flame holder 102 provide such clean combustion.

According to an embodiment, the perforated flame holder 102 may act as a heat source to maintain a combustion reaction even under conditions where a combustion reaction would not be stable when supported by a conventional flame holder. This capability can be leveraged to support combustion using a leaner fuel-to-oxidant mixture than is typically feasible. Thus, according to an embodiment, at the point where the fuel stream 206 contacts the input face 212 of the perforated flame holder 102, an average fuel-to-oxidant ratio of the fuel stream 206 is below a (conventional) lower combustion limit of the fuel component of the fuel stream 206—lower combustion limit defines the lowest concentration of fuel at which a fuel and oxidant mixture 206 will burn when exposed to a momentary ignition source under normal atmospheric pressure and an ambient temperature of 25° C. (77° F.).

The perforated flame holder 102 and systems including the perforated flame holder 102 described herein were found to provide substantially complete combustion of CO (single digit ppm down to undetectable, depending on experimental conditions), while supporting low NOx. According to one interpretation, such a performance can be achieved due to a sufficient mixing used to lower peak flame temperatures (among other strategies). Flame temperatures tend to peak under slightly rich conditions, which can be evident in any diffusion flame that is insufficiently mixed. By sufficiently mixing, a homogenous and slightly lean mixture can be achieved prior to combustion. This combination can result in reduced flame temperatures, and thus reduced NOx formation. In one embodiment, "slightly lean" may refer to 3% $O_2$, i.e. an equivalence ratio of ~0.87. Use of even leaner mixtures is possible, but may result in elevated levels of $O_2$. Moreover, the inventors believe perforation walls 308 may act as a heat sink for the combustion fluid. This effect may alternatively or additionally reduce combustion temperatures and lower NOx.

According to another interpretation, production of NOx can be reduced if the combustion reaction 302 occurs over a very short duration of time. Rapid combustion causes the reactants (including oxygen and entrained nitrogen) to be exposed to NOx-formation temperature for a time too short for NOx formation kinetics to cause significant production of NOx. The time required for the reactants to pass through the perforated flame holder 102 is very short compared to a conventional flame. The low NOx production associated with perforated flame holder combustion may thus be related to the short duration of time required for the reactants (and entrained nitrogen) to pass through the perforated flame holder 102.

Figure 4:
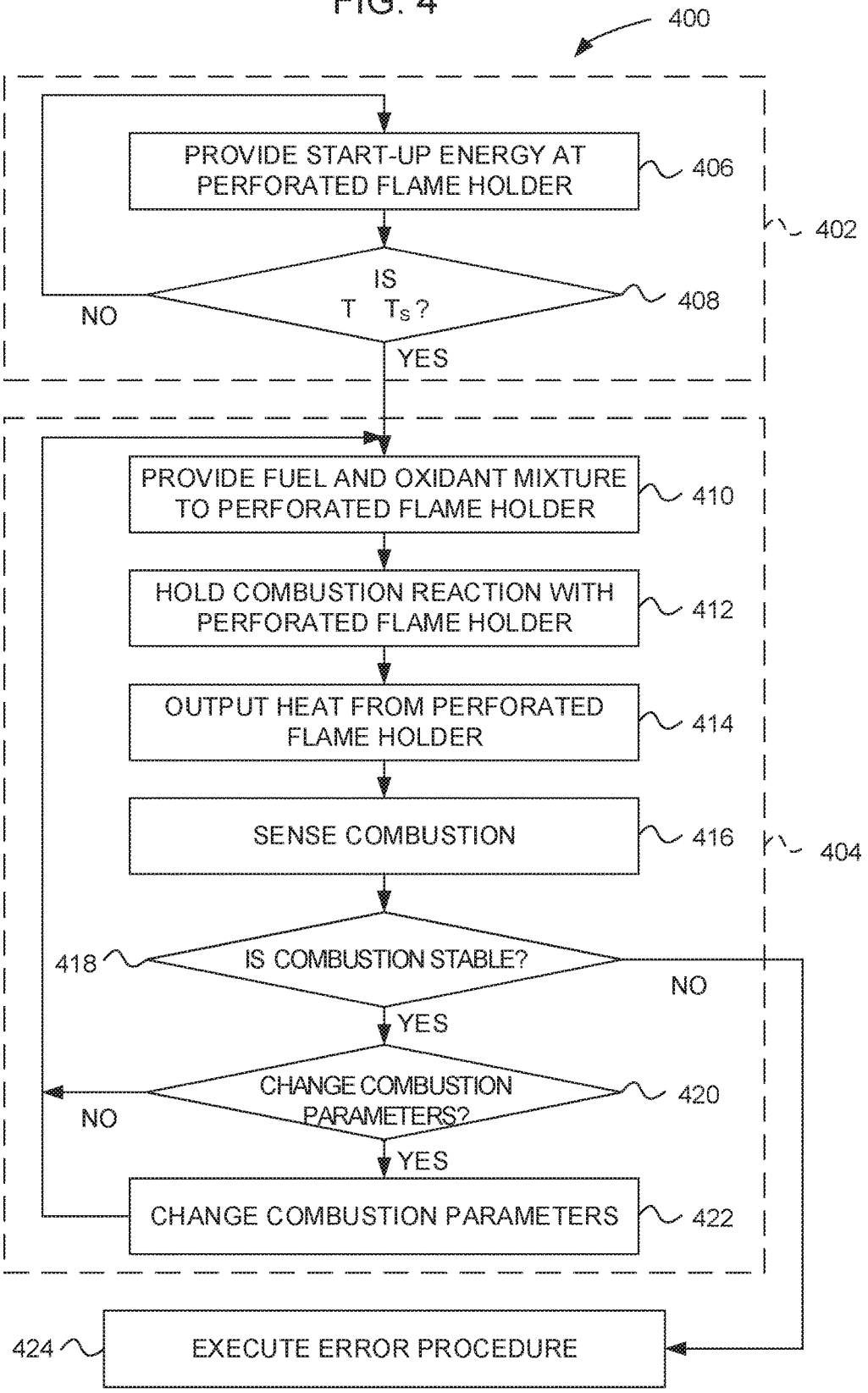
FIG. 4 is a flow chart showing a method for operating a burner system including the perforated flame holder of FIGS. 2 and 3, according to an embodiment.

FIG. 4 is a flow chart showing a method 400 for operating a burner system including the perforated flame holder shown and described herein. To operate a burner system including a perforated flame holder, the perforated flame holder is first heated to a temperature sufficient to maintain combustion of the fuel and oxidant mixture.

According to a simplified description, the method 400 begins with step 402, wherein the perforated flame holder is preheated to a start-up temperature, T. After the perforated flame holder is raised to the start-up temperature, the method proceeds to step 404, wherein the fuel and oxidant are provided to the perforated flame holder and combustion is held by the perforated flame holder.

According to a more detailed description, step 402 begins with step 406, wherein start-up energy is provided at the perforated flame holder. Simultaneously or following providing start-up energy, a decision step 408 determines whether the temperature T of the perforated flame holder is at or above the start-up temperature, $T_S$. As long as the temperature of the perforated flame holder is below its start-up temperature, the method loops between steps 406 and 408 within the preheat step 402. In step 408, if the temperature T of at least a predetermined portion of the perforated flame holder is greater than or equal to the start-up temperature, the method 400 proceeds to overall step 404, wherein fuel and oxidant is supplied to and combustion is held by the perforated flame holder.

Step 404 may be broken down into several discrete steps, at least some of which may occur simultaneously.

Proceeding from step 408, a fuel and oxidant mixture is provided to the perforated flame holder, as shown in step 410. The fuel and oxidant may be provided by a fuel and oxidant source that includes a separate fuel nozzle and oxidant (e.g., combustion air) source, for example. In this approach, the fuel and oxidant are output in one or more directions selected to cause the fuel and oxidant mixture to be received by the input face of the perforated flame holder. The fuel may entrain the combustion air (or alternatively, the combustion air may dilute the fuel) to provide a fuel and oxidant mixture at the input face of the perforated flame holder at a fuel dilution selected for a stable combustion reaction that can be held within the perforations of the perforated flame holder.

Proceeding to step 412, the combustion reaction is held by the perforated flame holder.

In step 414, heat may be output from the perforated flame holder. The heat output from the perforated flame holder may be used to power an industrial process, heat a working fluid, generate electricity, or provide motive power, for example.

In optional step 416, the presence of combustion may be sensed. Various sensing approaches have been used and are contemplated by the inventors. Generally, combustion held by the perforated flame holder is very stable and no unusual sensing requirement is placed on the system. Combustion sensing may be performed using an infrared sensor, a video sensor, an ultraviolet sensor, a charged species sensor, thermocouple, thermopile, flame rod, and/or other combustion sensing apparatuses. In an additional or alternative variant of step 416, a pilot flame or other ignition source may be provided to cause ignition of the fuel and oxidant mixture in the event combustion is lost at the perforated flame holder.

Proceeding to decision step 418, if combustion is sensed not to be stable, the method 400 may exit to step 424, wherein an error procedure is executed. For example, the error procedure may include turning off fuel flow, re-executing the preheating step 402, outputting an alarm signal, igniting a stand-by combustion system, or other steps. If, in step 418, combustion in the perforated flame holder is determined to be stable, the method 400 proceeds to decision step 420, wherein it is determined if combustion parameters should be changed. If no combustion parameters are to be changed, the method loops (within step 404) back to step 410, and the combustion process continues. If a change in combustion parameters is indicated, the method 400 proceeds to step 422, wherein the combustion parameter change is executed. After changing the combustion parameter(s), the method loops (within step 404) back to step 410, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 422. Conversely, if heat demand is increased, then fuel and oxidant flow may be increased. Additionally or alternatively, if the combustion system is in a start-up mode, then fuel and oxidant flow may be gradually increased to the perforated flame holder over one or more iterations of the loop within step 404.

Referring again to FIG. 2, the burner system 200 includes a heater 228 operatively coupled to the perforated flame holder 102. As described in conjunction with FIGS. 3 and 4, the perforated flame holder 102 operates by outputting heat to the incoming fuel and oxidant mixture 206. After combustion is established, this heat is provided by the combustion reaction 302; but before combustion is established, the heat is provided by the heater 228.

Various heating apparatuses have been used and are contemplated by the inventors. In some embodiments, the heater 228 can include a flame holder configured to support a flame disposed to heat the perforated flame holder 102. The fuel and oxidant source 202 can include a fuel nozzle 218 configured to emit a fuel stream 206 and an oxidant source 220 configured to output oxidant (e.g., combustion air) adjacent to the fuel stream 206. The fuel nozzle 218 and oxidant source 220 can be configured to output the fuel stream 206 to be progressively diluted by the oxidant (e.g., combustion air). The perforated flame holder 102 can be disposed to receive a diluted fuel and oxidant mixture 206 that supports a combustion reaction 302 that is stabilized by the perforated flame holder 102 when the perforated flame holder 102 is at an operating temperature. A start-up flame holder, in contrast, can be configured to support a start-up flame at a location corresponding to a relatively unmixed fuel and oxidant mixture that is stable without stabilization provided by the heated perforated flame holder 102.

The burner system 200 can further include a controller 230 operatively coupled to the heater 228 and to a data interface 232. For example, the controller 230 can be configured to control a start-up flame holder actuator configured to cause the start-up flame holder to hold the start-up flame when the perforated flame holder 102 needs to be pre-heated and to not hold the start-up flame when the perforated flame holder 102 is at an operating temperature (e.g., when $T \geq T_S$).

Various approaches for actuating a start-up flame are contemplated. In one embodiment, the start-up flame holder includes a mechanically-actuated bluff body configured to be actuated to intercept the fuel and oxidant mixture 206 to cause heat-recycling and/or stabilizing vortices and thereby hold a start-up flame; or to be actuated to not intercept the fuel and oxidant mixture 206 to cause the fuel and oxidant mixture 206 to proceed to the perforated flame holder 102. In another embodiment, a fuel control valve, blower, and/or damper may be used to select a fuel and oxidant mixture flow rate that is sufficiently low for a start-up flame to be jet-stabilized; and upon reaching a perforated flame holder 102 operating temperature, the flow rate may be increased to "blow out" the start-up flame. In another embodiment, the heater 228 may include an electrical power supply operatively coupled to the controller 230 and configured to apply an electrical charge or voltage to the fuel and oxidant mixture 206. An electrically conductive start-up flame holder may be selectively coupled to a voltage ground or other voltage selected to attract the electrical charge in the fuel and oxidant mixture 206. The attraction of the electrical charge was found by the inventors to cause a start-up flame to be held by the electrically conductive start-up flame holder.

In another embodiment, the heater 228 may include an electrical resistance heater configured to output heat to the perforated flame holder 102 and/or to the fuel and oxidant mixture 206. The electrical resistance heater can be configured to heat up the perforated flame holder 102 to an operating temperature. The heater 228 can further include a power supply and a switch operable, under control of the controller 230, to selectively couple the power supply to the electrical resistance heater.

An electrical resistance heater 228 can be formed in various ways. For example, the electrical resistance heater 228 can be formed from KANTHAL® wire (available from Sandvik Materials Technology division of Sandvik AB of Hallstaham mar, Sweden) threaded through at least a portion of the perforations 210 defined by the perforated flame holder body 208. Alternatively, the heater 228 can include an inductive heater, a high-energy beam heater (e.g. microwave or laser), a frictional heater, electro-resistive ceramic coatings, or other types of heating technologies.

Other forms of start-up apparatuses are contemplated. For example, the heater 228 can include an electrical discharge igniter or hot surface igniter configured to output a pulsed ignition to the oxidant and fuel. Additionally or alternatively, a start-up apparatus can include a pilot flame apparatus disposed to ignite the fuel and oxidant mixture 206 that would otherwise enter the perforated flame holder 102. The electrical discharge igniter, hot surface igniter, and/or pilot flame apparatus can be operatively coupled to the controller 230, which can cause the electrical discharge igniter or pilot flame apparatus to maintain combustion of the fuel and oxidant mixture 206 in or upstream from the perforated flame holder 102 before the perforated flame holder 102 is heated sufficiently to maintain combustion.

The burner system 200 can further include a sensor 234 operatively coupled to the control circuit 230. The sensor 234 can include a heat sensor configured to detect infrared radiation or a temperature of the perforated flame holder 102. The control circuit 230 can be configured to control the heating apparatus 228 responsive to input from the sensor 234. Optionally, a fuel control valve 236 can be operatively coupled to the controller 230 and configured to control a flow of fuel to the fuel and oxidant source 202. Additionally or alternatively, an oxidant blower or damper 238 can be operatively coupled to the controller 230 and configured to control flow of the oxidant (or combustion air).

The sensor 234 can further include a combustion sensor operatively coupled to the control circuit 230, the combustion sensor being configured to detect a temperature, video image, and/or spectral characteristic of a combustion reaction held by the perforated flame holder 102. The fuel control valve 236 can be configured to control a flow of fuel from a fuel source to the fuel and oxidant source 202. The controller 230 can be configured to control the fuel control valve 236 responsive to input from the combustion sensor 234. The controller 230 can be configured to control the fuel control valve 236 and/or oxidant blower or damper to control a preheat flame type of heater 228 to heat the perforated flame holder 102 to an operating temperature. The controller 230 can similarly control the fuel control valve 236 and/or the oxidant blower or damper to change the fuel and oxidant mixture 206 flow responsive to a heat demand change received as data via the data interface 232.

Figure 5:
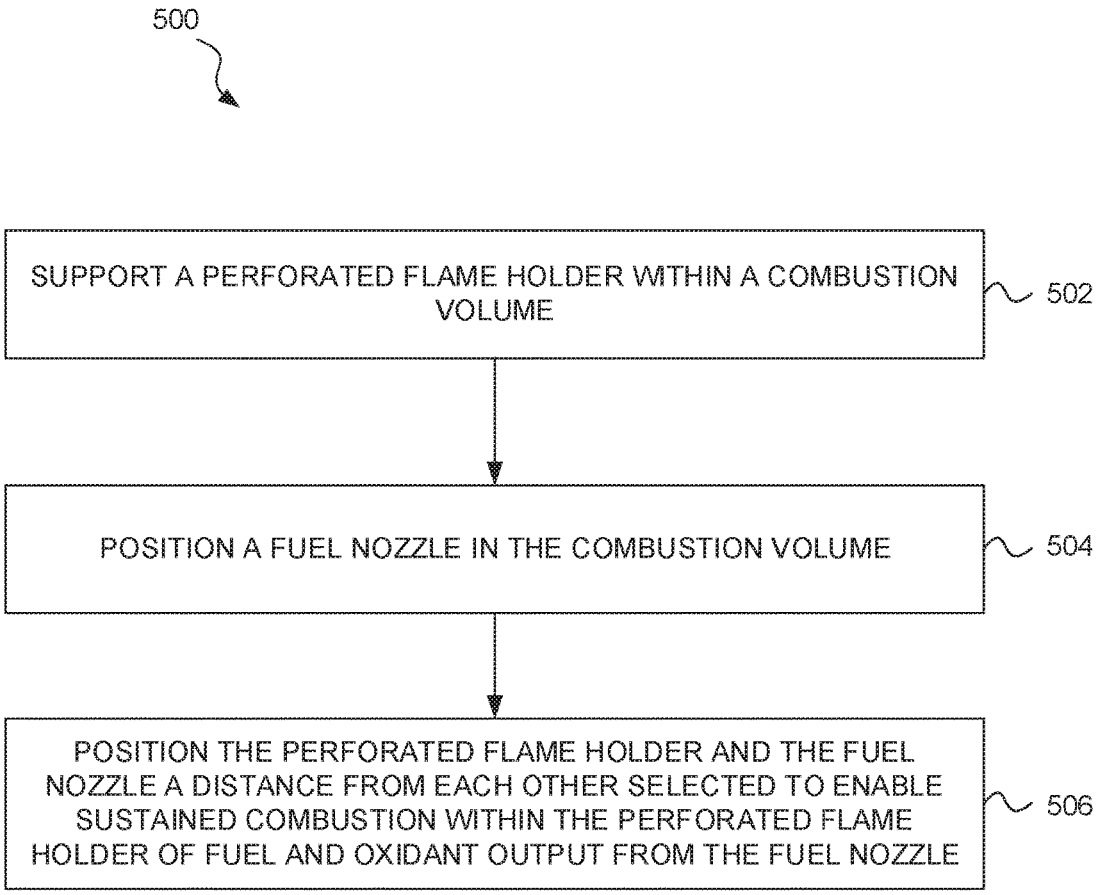
FIG. 5 is a flow diagram of a process for configuring a combustion system including a perforated flame holder, according to an embodiment.

FIG. 5 is a flow diagram of a method for configuring a combustion system including a perforated flame holder and a fuel nozzle, according to an embodiment. At 502, the perforated flame holder is supported within a combustion volume. At 504, a fuel nozzle is positioned within the combustion volume. At 506, the fuel nozzle and the perforated flame holder are positioned a selected distance from each other to enable combustion of fuel and oxidant from the fuel nozzle within the perforated flame holder.

According to an embodiment, the method includes supporting the perforated flame holder with a support structure. The support structure can be coupled to a wall, a ceiling, or a floor of a furnace defining the combustion volume. According to an embodiment, the support structure can include a metal super alloy. According to an embodiment, the support structure can include one or more portions coupled to a floor of the furnace and one or more portions coupled to a wall of the furnace.

According to an embodiment, the perforated flame holder includes multiple tiles join together. The support structure can include individual portions supporting each individual tile of the perforated flame holder. According to an embodiment, the support structure can include a refractory brick.

According to an embodiment, the support structure can define apertures selected to allow circulation of flue gas within the combustion volume.

According to an embodiment, the support structure supports the perforated flame holder a distance greater than 100 times a diameter of the fuel nozzle.

According to an embodiment, when configuring the combustion system, the position of the support structure and the fuel nozzle are selected so that the perforated flame holder will be a selected distance from the fuel nozzle when supported by the support structure. The selected distance is such that when fuel and oxidant are output from the fuel and oxidant source onto the perforated flame holder, the perforated flame holder can sustain a combustion reaction of the fuel and oxidant within the perforated flame holder.

According to an embodiment, the process 500 includes outputting fuel and oxidant from the fuel nozzle, receiving the fuel and oxidant at the perforated flame holder, and supporting a combustion reaction of the fuel and oxidant within the perforated flame holder While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A method comprising:

outputting fuel and oxidant from a fuel and oxidant source;

receiving the fuel and oxidant in a perforated flame holder;

supporting a majority of a combustion reaction of the fuel and oxidant within the perforated flame holder;

outputting heat from the perforated frame holder;

preheating the perforated flame holder to a threshold temperature, wherein preheating the perforated flame holder to the threshold temperature includes supporting a flame adjacent to the perforated flame holder and transferring heat to the perforated flame holder from the flame; and outputting the fuel and oxidant after the perforated flame holder has reached the threshold temperature.

2. The method of claim 1, comprising supporting 80% or more of the combustion reaction of the fuel and oxidant within the perforated flame holder.

3. The method of claim 1, comprising sensing the combustion reaction with a sensor.

4. The method of claim 3, wherein sensing the combustion reaction includes sensing whether the combustion reaction is stable.

5. The method of claim 4, comprising executing an error procedure if the combustion reaction is not stable.

6. The method of claim 5, wherein executing the error procedure includes applying heat to the perforated flame holder.

7. The method of claim 4, comprising adjusting an output of fuel and oxidant from the fuel source if the combustion reaction is stable.

8. The method of claim 1, wherein supporting the flame adjacent to the perforated flame holder includes holding the flame at an electrical conductor positioned adjacent to the perforated flame holder by applying a voltage to the electrical conductor.

9. The method of claim 1, comprising removing the flame when the perforated flame holder reaches the threshold temperature.

10. The method of claim 1, wherein outputting the fuel and oxidant includes outputting a mixture of the fuel and oxidant from a fuel nozzle.

11. The method of claim 10, comprising premixing the fuel and oxidant prior to outputting the mixture of fuel and oxidant from the fuel nozzle.

12. The method of claim 1, wherein outputting the fuel and oxidant includes outputting the fuel and oxidant from a plurality of nozzles.

13. The method of claim 1, wherein the perforated flame holder includes:

an input surface proximal to the fuel and oxidant source;

an output surface distal from the fuel and oxidant source; and a plurality of perforations extending between the input surface and the output surface.

14. The method of claim 13, wherein receiving the fuel and oxidant includes receiving the fuel and oxidant into the plurality of perforations.

15. The method of claim 14, wherein supporting the majority of the combustion reaction within the perforated flame holder includes supporting the majority of the combustion reaction within the perforations.

16. The method of claim 1, comprising transferring heat from the perforated flame holder to a working fluid.

17. The method of claim 1, comprising:

absorbing, in a body of the perforated flame holder, heat from the combustion reaction within the perforated flame holder; and supporting the combustion reaction within the perforated flame holder by transferring heat from the body of the perforated flame holder to the mixture of fuel and oxidant received by the perforated flame holder.

18. The method of claim 1, comprising:

preheating the perforated flame holder to a threshold temperature;

outputting the fuel and oxidant onto the perforated flame holder when the perforated flame holder reaches the threshold temperature; and initiating a combustion reaction of the fuel and oxidant within the perforated flame holder by transferring heat from the perforated flame holder to the fuel and oxidant.

19. The method of claim 18, wherein the threshold temperature corresponds to a temperature at which the fuel and oxidant will combust within the perforated flame holder.

20. The method of claim 1, wherein outputting the fuel and oxidant includes outputting the fuel and oxidant from a nozzle having a diameter D and being positioned from perforated flame holder a distance at least 100 times greater than the diameter D.

21. The method of claim 1, comprising inhibiting flashback of the fuel and oxidant by positioning a flame arrestor between the fuel and oxidant source and the perforated flame holder.

22. The method of claim 1, comprising supporting the perforated flame holder within a furnace by fixing the perforated flame holder to a support structure coupled to a wall, floor, or ceiling of the furnace.

23. The method of claim 1, wherein a width of the perforated flame holder is more than 6 times as great as a thickness of the perforated flame holder, wherein the thickness of the perforated flame holder corresponds to a distance between an input surface and an output surface of the perforated flame holder.

24. The method of claim 1, wherein the perforated flame holder includes a plurality of individual tiles positioned in contact with each other.

25. The method of claim 1, wherein the perforated flame holder includes an input surface, an output surface, and a plurality of perforations extending between the input and output surfaces, a width of the perforations being less than 0.5inches (12.7 millimeters).

26. The method of claim 1, wherein the perforated flame holder includes one or more of a refractory material, a fiber reinforced refractory material, a metal super alloy, Inconel, Hastelloy, or a ceramic material.

27. The method of claim 1, wherein the perforated flame holder includes a plurality of tubes bundled together.

28. The method of claim 1, wherein a mixture of the fuel and oxidant received by the perforated flame holder is leaner than could sustain a stable combustion reaction without effects of the perforated flame holder.

29. The method of claim 1, comprising generating NOx from the combustion reaction at concentration of less than 3 ppm.

30. A method comprising:

supporting, with a support structure, a perforated flame holder in a combustion volume of a furnace;

positioning a fuel nozzle within the combustion volume a distance from the perforated flame holder selected to enable fuel and oxidant output from the fuel nozzle to arrive at the perforated flame holder in a condition that enables the perforated flame holder to support a combustion reaction of the fuel and oxidant within the perforated flame holder;

preheating the perforated flame holder to a threshold temperature, wherein preheating the perforated flame holder to the threshold temperature includes supporting a flame adjacent to the perforated flame holder and transferring heat to the perforated flame holder from the flame; and outputting the fuel and oxidant from the fuel nozzle after the perforated flame holder has reached the threshold temperature.

31. The method of claim 30, wherein the support structure is coupled to a wall of the furnace.

32. The method of claim 30, wherein the support structure is coupled to a floor of a furnace.

33. The method of claim 30, wherein the support structure includes a metal super alloy.

34. The method of claim 30, wherein the support structure is configured to support the perforated flame holder the selected distance from the fuel nozzle.

35. The method of claim 30, comprising positioning the perforated flame holder on the support structure.

36. The method of claim 30, wherein the selected distance is more than 100 time greater than a diameter of the fuel nozzle.

37. The method of claim 30, comprising:

receiving the fuel and oxidant at the perforated flame holder; and sustaining a combustion reaction of the fuel and oxidant within the perforated flame holder.

* * * * *